US007070308B2

(12) United States Patent
Shikano

(10) Patent No.: US 7,070,308 B2
(45) Date of Patent: Jul. 4, 2006

(54) LIGHT PROJECTOR

(75) Inventor: Toshiya Shikano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/396,227

(22) Filed: Mar. 24, 2003

(65) Prior Publication Data

US 2003/0189839 A1 Oct. 9, 2003

(30) Foreign Application Priority Data

Apr. 5, 2002 (JP) ..... 2002-104005

(51) Int. Cl.
*F21V 11/00* (2006.01)

(52) U.S. Cl. ..... 362/510; 362/19; 362/509; 359/495

(58) Field of Classification Search ..... 362/507, 362/509, 510, 19, 296, 247; 359/483, 485, 359/495

See application file for complete search history.

(56) References Cited

U.S. PATENT DOCUMENTS

| | | | | |
|---|---|---|---|---|
| 3,808,422 A | | 4/1974 | Handtmann et al. | 362/19 |
| 5,535,054 A | * | 7/1996 | Shibuya | 359/487 |
| 6,193,393 B1 | * | 2/2001 | Dove et al. | 362/251 |
| 6,208,463 B1 | | 3/2001 | Hansen et al. | 359/486 |
| 6,373,629 B1 | | 4/2002 | Yamagishi et al. | 359/487 |

FOREIGN PATENT DOCUMENTS

| | | |
|---|---|---|
| CN | 1146742 C | 4/2004 |
| CN | 1165785 C | 9/2004 |
| DE | 973 383 | 2/1960 |
| GB | 880374 | 10/1961 |
| JP | 61-253236 | 11/1986 |

OTHER PUBLICATIONS

English translation of reference DE 973 383 C.

* cited by examiner

*Primary Examiner*—John Anthony Ward
(74) *Attorney, Agent, or Firm*—Hamre, Schumann, Mueller & Larson, P.C.

(57) ABSTRACT

A light projector includes a polarized light splitter 3 that splits unpolarized light irradiated from a light source 1 into p-polarized light and s-polarized light, and the p-polarized light and/or the s-polarized light are irradiated as vertical polarized light and/or horizontal polarized light, providing a driver with considerably improved forward visibility in comparison with a conventional headlight.

7 Claims, 9 Drawing Sheets

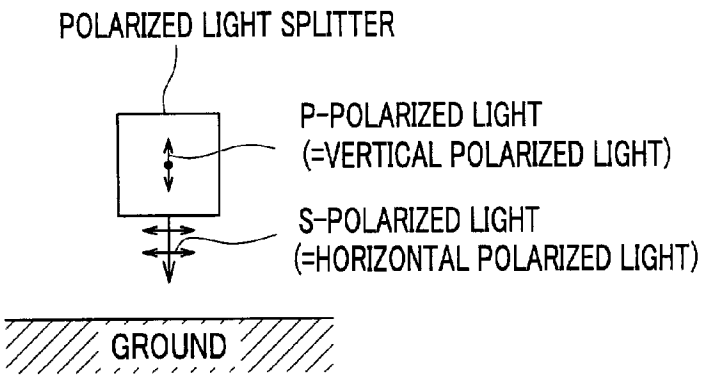
FIG.2A
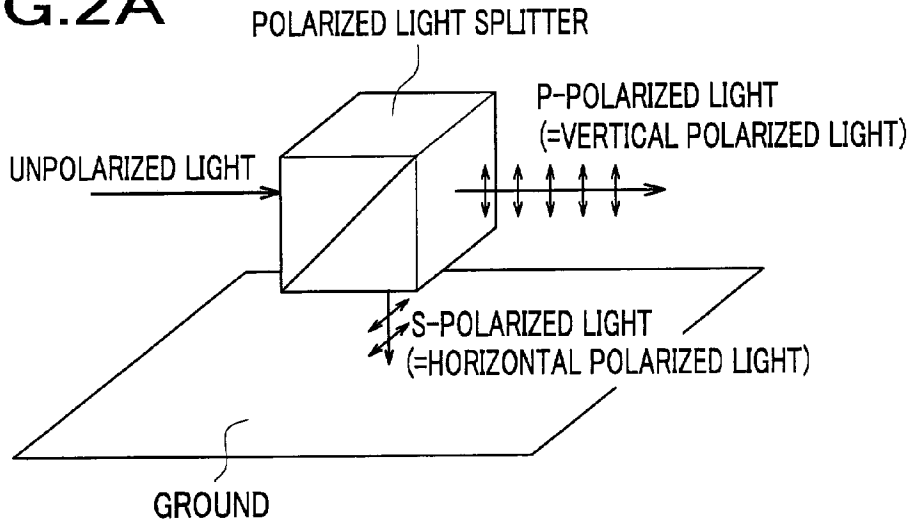
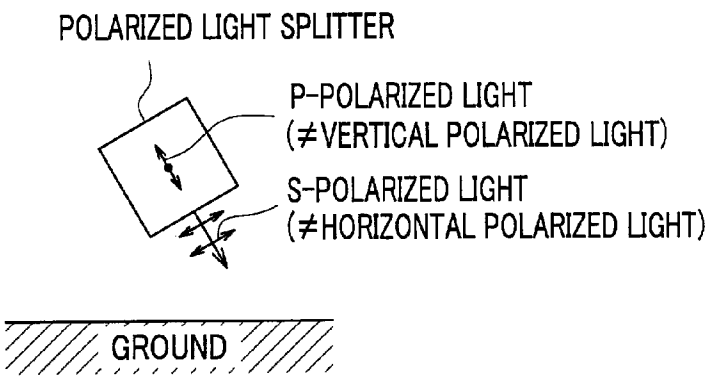
FIG.2B
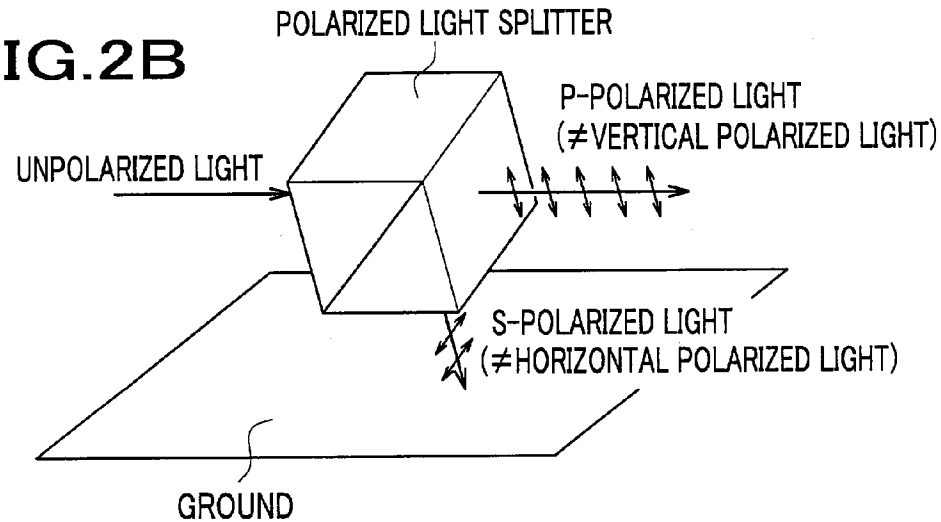

DISTRIBUTION OF LIGHT IRRADIATED FROM A CONVENTIONAL HEADLIGHT IN HEAVY FOG OR IN A DOWNPOUR OF RAIN

DISTRIBUTION OF LIGHT IRRADIATED FROM A FEADLIGHT ACCORDING TO THE INVENTION IN HEAVY FOG OR IN A DOWNPOUR OF RAIN

LIGHT PROJECTOR

BACKGROUND OF THE INVENTION

This invention relates to a light projector such as a headlight for use with a vehicle.

The headlight for use with a vehicle is operated to light up under circumstances where a driver recognizes difficulty in seeing an area ahead of the vehicle with the unaided eye. The headlight is typically used in the nighttime, in a downpour of rain, in fog, or in other similar conditions. Actually, in some instances where the headlight is lit in a downpour of rain or in fog, an irradiated light beam diffuses by reflecting off raindrops and fine particles of water vapor, and the driver's view is obstructed by, as it were, a light wall standing in front of the vehicle.

A technique utilizing polarization for a headlight of a vehicle is disclosed in JP 61-253236 A. The invention as disclosed in this publication is directed to a technique for preventing a headlight providing a high beam from dazzling a driver. To be more specific, two polarizing filters are provided: one is provided in an optical path of the headlight for irradiating a high beam, and the other is stuck on a windshield, so that a polarization axis of the latter is perpendicular to that of the former. Accordingly, the high beam is cut off using the two polarizing filters (one on the windshield of the driver's vehicle, and the other in the headlight of oncoming vehicles), and the driver can thereby be prevented from being dazzled.

However, in the invention disclosed in JP 61-253236 A, disadvantageously, neither rain nor fog is envisaged as the problems to be addressed, and the use of polarizing filters would impair efficiency in utilization of light irradiated by the headlight. Moreover, the polarizing filter disadvantageously has low heat resistance (only up to 50° C.) in general, and thus attachment thereof to a headlight or the use in midsummer would significantly impair a polarizing capability thereof through the addition of heat derived from a lamp of the headlight or from sunbeams.

SUMMARY OF THE INVENTION

It is an exemplified general object of the present invention to provide a light projector, in which the above disadvantages can be eliminated. Another exemplified and more specific object of the present invention is to provide a light projector that has high efficiency in utilization of light irradiated from a headlight, and in high heat resistance, and that can ensure considerably increased forward visibility under conditions which would restrict the visibility.

A light projector according to the present invention includes a light source, and a polarized light splitter that splits a beam of unpolarized light irradiated from the light source into p-polarized light and s-polarized light, and the p-polarized light and/or the s-polarized light are irradiated as vertical polarized light having electric field plane of vibration substantially vertical to level ground, and/or as horizontal polarized light having electric field plane of vibration substantially parallel to the level ground.

With the light projector according to the present invention as above, a beam of light irradiated from the light source is split into p-polarized light and s-polarized light, and then the p-polarized light and/or the s-polarized light are utilized as vertical polarized light having electric field plane of vibration substantially vertical to level ground and/or horizontal polarized light having electric field plane of vibration substantially parallel to the level ground; therefore, considerably increased forward visibility can be ensured under conditions which would restrict the visibility while keeping high efficiency in utilization of light and high heat resistance.

Hereupon, the p-polarized light and the s-polarized light are defined in relation to the polarized light splitter; the p-polarized light has a direction of vibration of the electric field parallel to a plane of incidence of the polarized light splitter, while the s-polarized light has a direction of vibration of the electric field perpendicular to the plane of incidence of the polarized light splitter. The plane of incidence is, as shown in FIG. 1, a plane containing the normal at the point where incident light strikes a reflecting surface, and an optical axis of the incident light.

In contrast, the vertical polarized light and the horizontal polarized light are defined in relation to the direction of vibration of the electric field of the polarized light with respect to the ground to which light is irradiated. It is thus to be understood that the vertical polarized light and the horizontal polarized light are the concepts distinct from the p-polarized light and the s-polarized light as described above. Light having a direction of vibration of the electric field substantially vertical to the level ground (reflecting surface) is herein termed vertical polarized light, while light having a direction of vibration of the electric field substantially parallel to the level ground (reflecting surface) is herein termed horizontal polarized light. In other words, the vertical polarized light adequately refers to polarized light having a direction of vibration of the electric field substantially parallel to a plane of incidence of light which strikes the ground, and the horizontal polarized light adequately refers to polarized light having a direction of vibration of the electric field substantially vertical to the plane of incidence of light which strikes the ground.

Referring now to FIGS. 2A and 2B, a detailed description will be given of a distinct difference in concept between the s- or p-polarized light and vertical or horizontal polarized light. FIG. 2A shows directions of vibration of p-polarized light and s-polarized light split by the polarized light splitter which is placed in an orientation as illustrated therein with respect to the ground. In FIG. 2A, the p-polarized light that has been split off becomes vertical polarized light having a direction of vibration vertical (i.e., perpendicular to the ground), and the s-polarized light that has been split off becomes horizontal polarized light having a direction of vibration horizontal (i.e., parallel to the ground).

FIG. 2B shows directions of vibration of p-polarized light and s-polarized light split by the polarized light splitter which is placed in an orientation tilted with respect to the ground. In this instance, as contrasted with the arrangement as shown in FIG. 2A, the polarized light splitter tilts with respect to the ground; therefore, the s-polarized light is not identical with the horizontal polarized light, and the p-polarized light is not identical with the vertical polarized light.

In a light projector which embodies one exemplified aspect of the present invention, one of the p-polarized light and the s-polarized light is irradiated farther from the light source as the vertical polarized light, and the other of the p-polarized light and the s-polarized light is irradiated to an area nearer to the light source as the horizontal polarized light.

It is generally known that the p-polarized light having a direction of vibration parallel to the plane of incidence exhibits lower reflectance than that of the s-polarized light having a direction of vibration vertical to the plane of incidence.

The vertical polarized light, if incident on top or under surfaces of raindrops, or the level ground, as reflecting surfaces, have a direction of vibration parallel to the plane of incidence; thus, the reflectance of the vertical polarized light which strikes the raindrops or a film of water on the surface of the road and reflects in a vertical direction is lower than that of the horizontal vertical polarized light, as is the above-described case with the p-polarized light.

Reflection on the raindrops or the surface of the road which could impair visibility is mainly derived from light reflected and diffused in a direction vertical to the ground.

Accordingly, irradiation of the vertical polarized light toward areas farther from the light source makes it possible to restrict vertically diffusing reflection, which would be caused by raindrops, fine particles of water vapor, a film of water on the surface of the road generated in a downpour of rain or in heavy fog, and would thus impair visibility. Resultantly, the light projector according to this aspect of the present invention can maintain better forward visibility in comparison with any conventional light projectors that irradiate unpolarized light.

Moreover, irradiation of the horizontal polarized light toward areas nearer to the light source makes it possible to ensure visibility of areas around the light source, and to enhance efficiency in utilization of light irradiated from the light source.

In a light projector which embodies another exemplified aspect of the present invention, one of the p-polarized light and the s-polarized light is irradiated as first vertical polarized light, and the other of the p-polarized light and the s-polarized light is changed into second vertical polarized light utilizing a phase changer and irradiated as the second vertical polarized light.

With the light projector according to this aspect of the present invention, the p-polarized light and s-polarized light that has been split by the polarized light splitter are both irradiated forward as the vertical polarized light, and such arrangement makes it possible to restrict vertically diffusing reflection, which would be caused by raindrops, fine particles of water vapor, a film of water on the surface of the road generated in a downpour of rain or in heavy fog, and would thus impair visibility. Consequently, the light projector according to this aspect of the present invention can maintain better forward visibility under the bad conditions as above, in comparison with any conventional light projectors that irradiate unpolarized light.

In the light projector according to this aspect of the present invention, the phase changer may be a ½ wavelength retardation plate. The use of the ½ wavelength retardation plate for the phase changer allows the light projector to change the s-polarized light or p-polarized light to vertical polarized light efficiently with almost no loss of the amount of light.

In the light projector according to every aspect of the present invention as described above, the polarized light splitter may be made of material which is birefringent. The use of a birefringent material as the polarized light splitter allows the light projector to efficiently split unpolarized light into s-polarized light and p-polarized light.

The above-described light projector according to the present invention may be used for a headlight for a vehicle. The vehicle that adopts the light projector as headlights thereof can reliably provide the driver with better forward visibility under tough conditions (e.g., in heavy fog, or in a downpour of rain) in comparison with any conventional headlights.

Other objects and further features of the present invention will become readily apparent from the following description of preferred embodiments with reference to accompanying drawings.

BRIEF DESCRIPTION OF THE DRAWINGS

FIG. 2A shows p-polarized light identical with vertical polarized light and s-polarized light identical with horizontal polarized light, generated by a polarized light splitter that is oriented vertically.

FIG. 2B shows p-polarized light and s-polarized light, generated by a polarized light splitter that is tilted with respect to the ground.

DETAILED DESCRIPTION OF THE PREFERRED EMBODIMENTS

Exemplified embodiments of the present invention will be described with reference made to the drawings as deemed appropriate.

The principle behind a light projector according to the present invention will now be described to explain why improved forward visibility in comparison with conventional light projectors can be provided.

Figure 3:
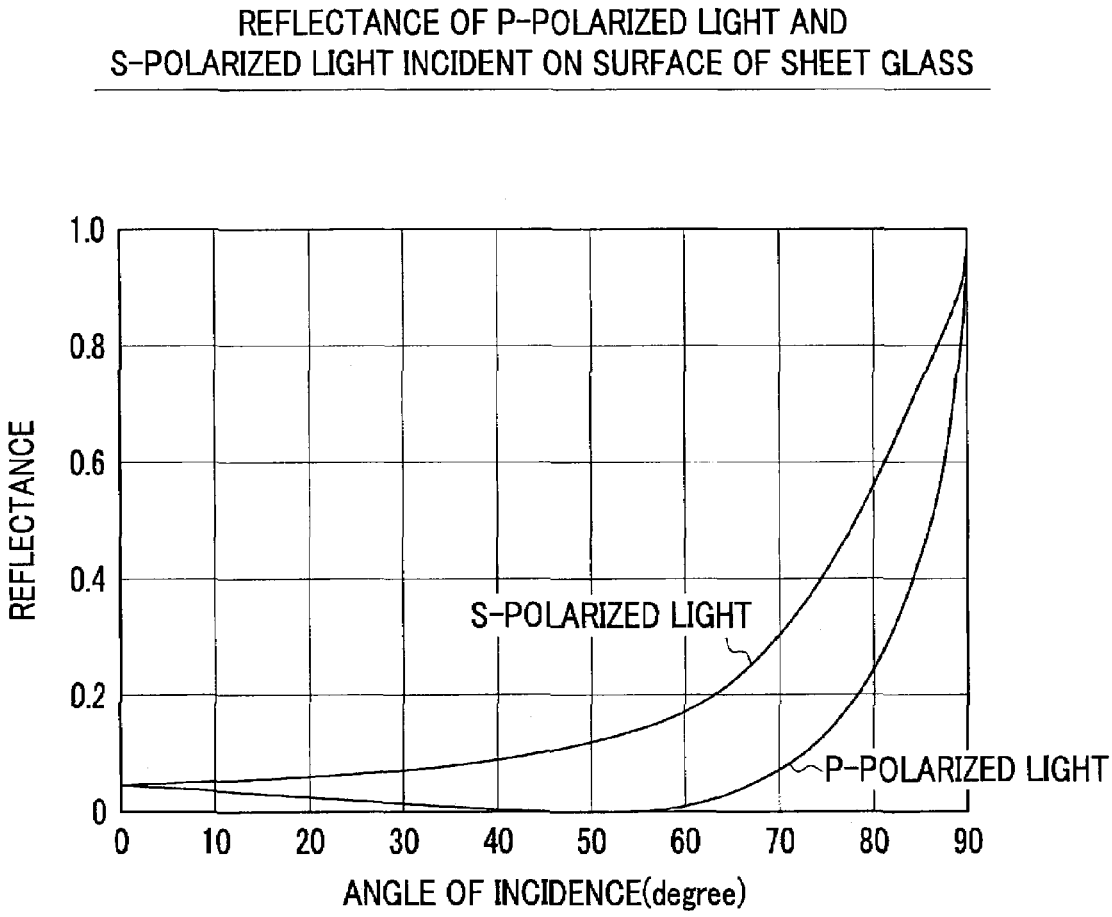
FIG. 3 shows a graph showing reflectance of p-polarized light and s-polarized light each having a predetermined wavelength, incident on a surface of glass material.

FIG. 3 is a graph showing reflectance of p-polarized light and s-polarized light each having a predetermined wavelength, incident on a surface of a glass material (refractive index=1.51673). The ordinates represent reflectance, and the abscissas represent angles of incidence of a light beam where the angle formed with the normal of the surface (reflecting surface) of the glass material is zero degrees.

Figure 1:
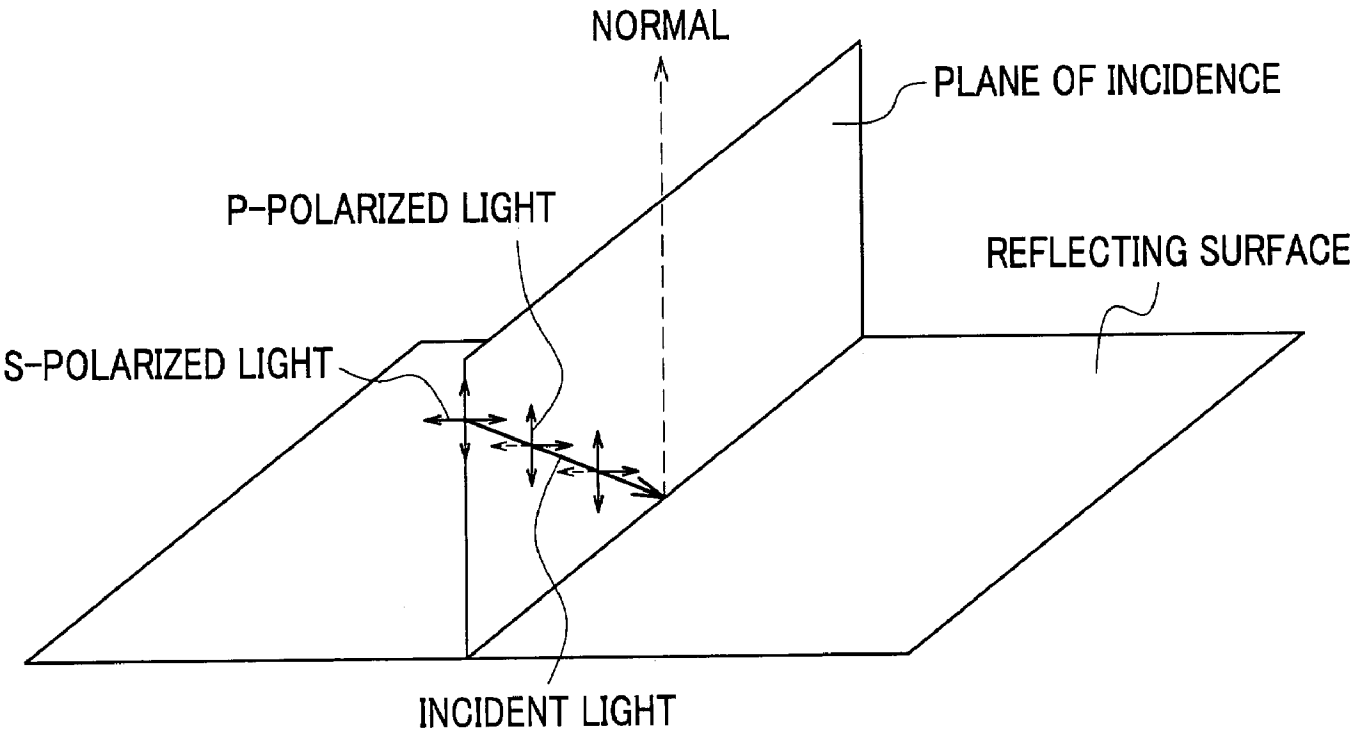
FIG. 1 shows a plane of incidence relative to a reflecting surface.

The p-polarized light as herein referred to has a direction of vibration of the electric field parallel to the plane of incidence, and corresponds to the vertical polarized light as defined in relation to the present invention which has a direction of vibration vertical with respect to the ground upon reflecting a surface parallel to the ground (see FIG. 1). The s-polarized light, on the other hand, has a direction of vibration of the electric field vertical to the plane of incidence, and corresponds to the horizontal polarized light as defined in relation to the present invention which has a direction of vibration horizontal with respect to the ground upon reflecting a surface parallel to the ground (see also FIG. 1).

Referring to the graph of FIG. 3, it is clearly shown that the reflectance of the s-polarized light (horizontal polarized light) is greater than the reflectance of the p-polarized light (vertical polarized light), with the exception of cases where the angle of incidence is 0 degrees or 90 degrees. In particular, when the angle of incidence ranges between 20 degrees and 80 degrees, the reflectance of the s-polarized light (horizontal polarized light) is more than twice as great as the reflectance of the p-polarized light (vertical polarized light).

Although the above description relies upon FIG. 3 in which light strikes on a surface of glass, the same is the case with water (a top or under surface thereof) such as a water droplet; namely, the reflectance of the p-polarized light (vertical polarized light) is greater than that of the s-polarized light (horizontal polarized light).

Incidentally, when a headlight of a vehicle is lit up in heavy fog or in a downpour of rain, irradiated light sometimes produces a phenomenon that seems as if a light wall emerges in front of the vehicle, so that the driver cannot sufficiently be provided with good forward visibility in some instances. This is because the light irradiated from the headlight diffuses by reflecting off raindrops or fine particles of water vapor, and especially because the light diffusively reflects mainly in directions substantially vertical to the ground.

Figure 4:
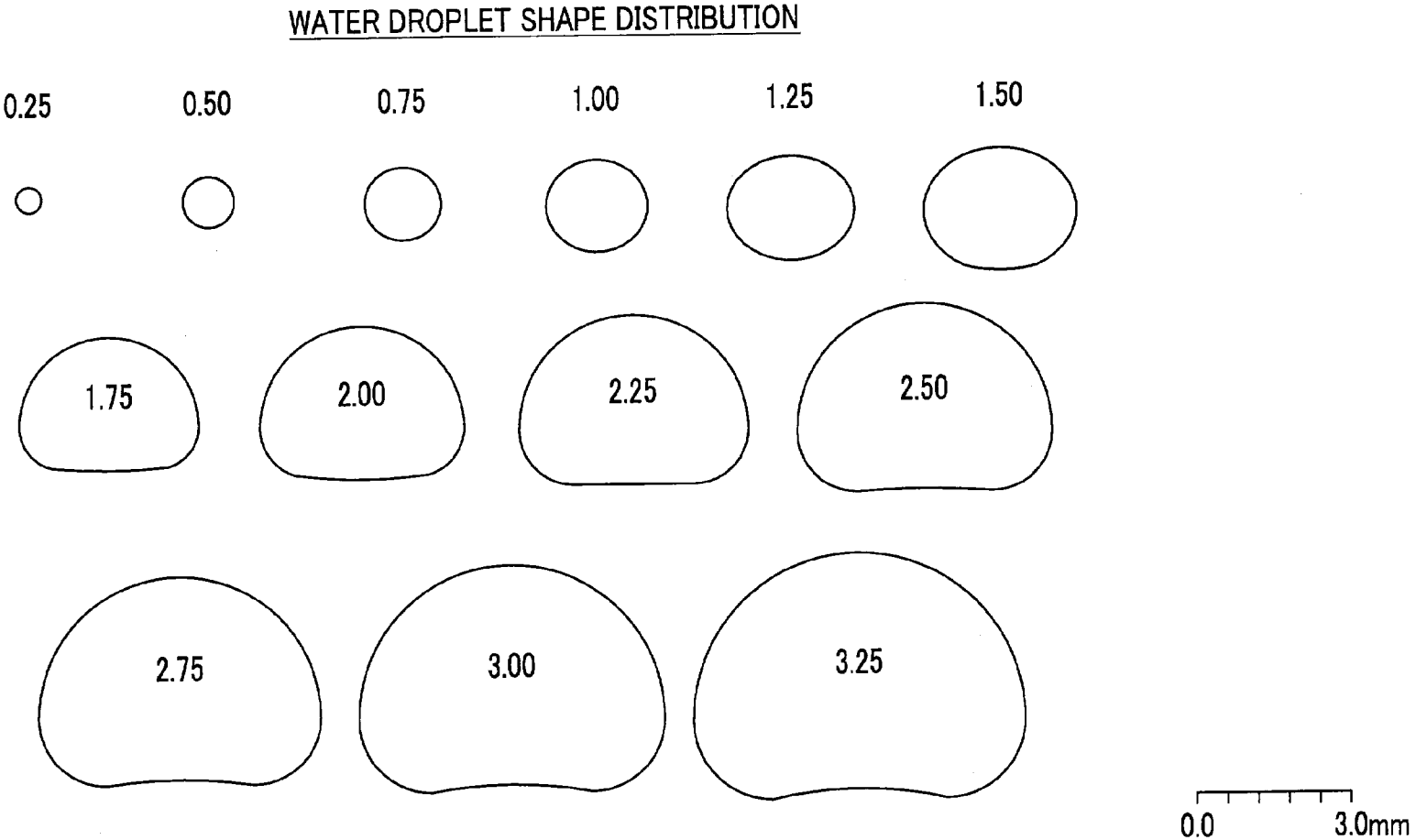
FIG. 4 shows shapes of water droplets flying from the air in heavy fog or in a downpour of rain.

Shown in FIG. 4 are shapes of water droplets flying from the air in heavy fog or in a downpour of rain. Each water droplet is substantially spherical in shape, but the larger a particle diameter thereof, the more oblate the water droplet is made by air resistance given during falling, and a superficies thereof increases accordingly. The water droplet, as thus shaped, makes the light irradiated from the headlight and incident thereon from a sideward direction diffuse in every direction, particularly so as to diffusively reflect in a direction substantially vertical to the ground. Moreover, since the number density or number of water droplets per unit volume is large in heavy fog or in a downpour of rain, the light once diffusively reflecting off the water droplets reflects off a great number of water droplets that exist in the neighborhood again and again, and an entire area irradiated by the light of the headlight illuminates, and makes the driver feel as if a light wall emerges near around the vehicle. In particular, light reflecting in directions vertical to the ground obstructs the driver's view, so that the driver can hardly see a distant place.

Figure 5A:
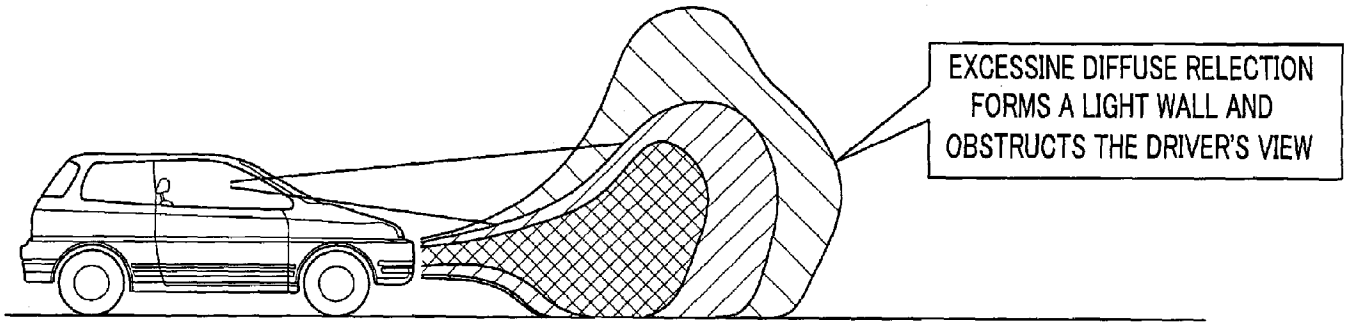
FIG.5A PRIOR ART
FIG. 5A is a schematic diagram showing distribution of light irradiated from a headlight.

Distribution of light irradiated from the headlight under the conditions as described above is schematically shown in FIG. 5A. The light irradiated from the headlight randomly diffuses by reflecting off the surfaces of raindrops or fine particles of water vapor which exist on passages of the light, and forms a light wall near around the vehicle, making it difficult for the driver to get the visibility of areas far from the vehicle.

Figure 5B:
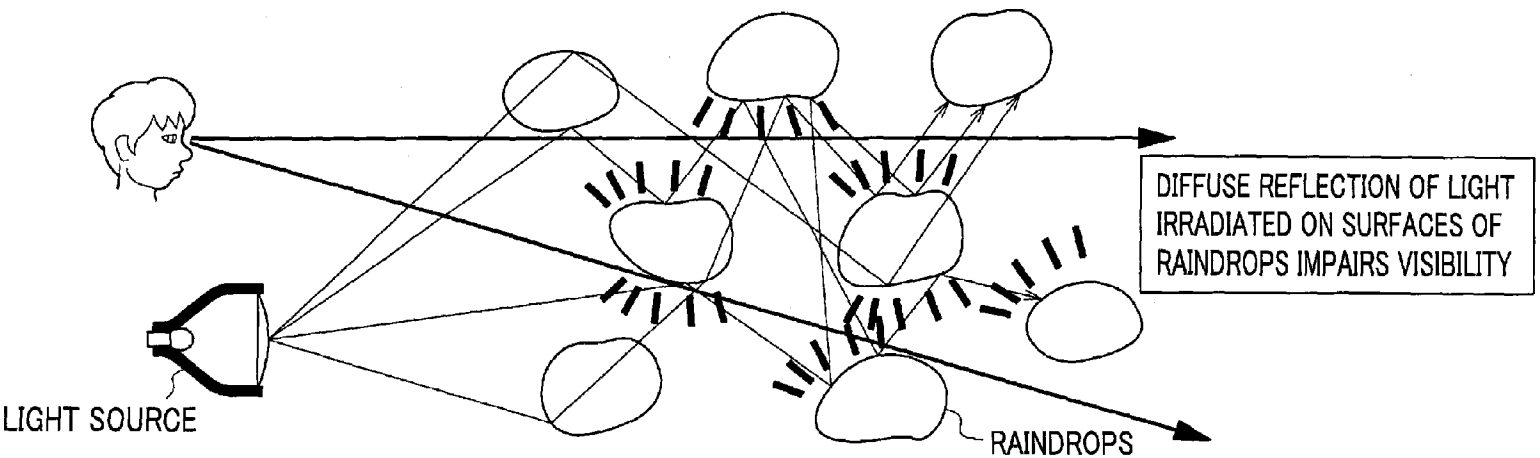
FIG.5B PRIOR ART
FIG. 5B is a schematic diagram showing diffusion of light which takes place as a result of reflection of light beams irradiated from a headlight on the surfaces of raindrops.

FIG. 5B is a schematic illustration of diffusion of light taking place by reflecting off the surfaces of raindrops when the light is irradiated from a headlight. As shown in FIG. 5B, the light repeatedly reflects on the surfaces of raindrops in a variety of directions, and gives an visual image as if a light wall emerges in front of the vehicle. Under the circumstances, the driver cannot see an object that could be seen under a normal condition.

Assuming that diffusion as a result of reflection of light irradiated from the headlight on the surfaces of raindrops or fine particles of water vapor, especially vertically diffusive reflection which mainly impairs visibility, can be restricted, forward visibility can be ensured more reliably, and the vehicle can be operated more comfortably, than could be using a conventional headlight.

In order to actualize the above assumption, it is conceivable as one effective means that the light irradiated from the headlight may be converted into vertical polarized light. This allows vertically diffusive reflection of light to be considerably reduced in comparison with the case in which unpolarized light is irradiated, because the reflectance of the vertical polarized light in a direction vertical to the ground is less than that of the horizontal polarized light. In other words, the above means serves to restrict the reflected light from diffusing in a vertical direction, and thus serves to prevent a light wall from being formed. Therefore, the driver's view is not obstructed, so that the driver can be reliably provided with good forward visibility.

Figure 6:
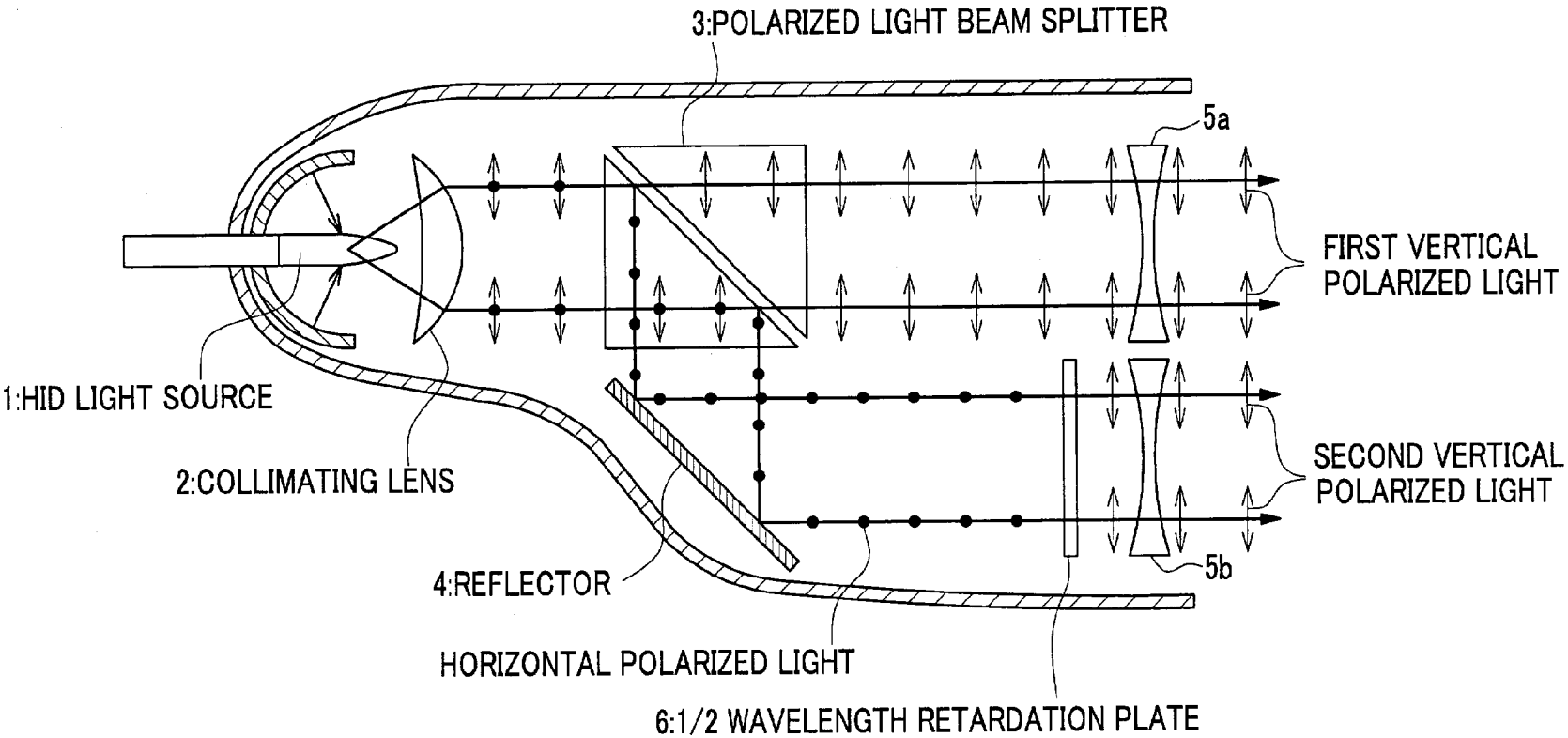
FIG. 6 is a schematic diagram showing one exemplified embodiment of a light projector according to the present invention.

FIG. 6 is a schematic diagram showing one exemplified embodiment of a light projector according to the present invention. In the depicted embodiment, light irradiated from a light source is split into p-polarized light and s-polarized light, so that the p-polarized light is irradiated as first vertical polarized light, and further the s-polarized light formed by splitting the unpolarized light is changed into second vertical polarized light utilizing a phase changer and irradiated as the second vertical polarized light; consequently, the light projector irradiates the first and second vertical polarized light forward of a vehicle.

It is understood that a polarized light beam splitter 3 is provided as a polarized light splitting means in a manner as shown in FIG. 2A, and the following equations are thus satisfied: the p-polarized light=vertical polarized light; the s-polarized light=horizontal polarized light.

The light projector according to the present embodiment includes a light source 1, a collimating lens 2 for making light (unpolarized light) irradiated from the light source 1 into parallel beams of light by making angles of irradiation in alignment with one another, a polarized light beam splitter 3 for splitting the beams of light from the collimating lens 2 into p-polarized light (first vertical polarized light) and s-polarized light (horizontal polarized light), a reflector 4 for reflecting the s-polarized light (horizontal polarized light) generated by splitting the collimated beams of light utilizing the polarized light beam splitter 3, and a ½ wavelength retardation plate (or sheet) 6 for changing the s-polarized light (horizontal polarized light) into second vertical polarized light, with lenses 5*a*, 5*b* used for irradiating forward light irradiated from the light projector.

Hereupon, the terms "polarized light splitter" and "phase changer" used for describing the present invention correspond to the polarized light beam splitter 3 and the ½ wavelength retardation plate 6, respectively. In the present embodiment, a collimating lens is used to make light irradiated from the light source into parallel beams, but a concave mirror such as a parabolic reflector may be used instead.

Light (unpolarized light) irradiated from an HID (high intensity discharge) light or other light source (light source 1) is converted into parallel beams using the collimating lens 2, and strikes on the polarized light beam splitter 3. P-polarized light formed herein does not reflect in the polarized light beam splitter 3 but passes through the polarized light beam splitter 3, to reach the lens 5, and is irradiated forward of the vehicle as first vertical polarized light. On the other hand, s-polarized light reflects and changes a traveling direction thereof in the polarized light beam splitter 3, to reach the reflector 4, in which an irradiating direction thereof is adjusted; the s-polarized light is then changed in direction of polarization upon passing through the ½ wavelength retardation plate 6, and made into second vertical polarized light, passing through the lens 5*b* to be irradiated forward of the vehicle. The ½ wavelength retardation plate 6 is disposed in an orientation that tilts at 45 degrees toward a direction allowing the direction of polarization to change with respect to the optical axis so that the direction of polarization changes by an angle of 90 degrees.

As described above, in this embodiment of the light projector according to the present invention, light irradiated from the light source 1 is split up into p-polarized light and s-polarized light; the p-polarized light is set to be first vertical polarized light, and the s-polarized light is converted into second vertical polarized light, so that only the vertical polarized light having lower reflectance in a direction vertical to the ground is irradiated forward of the vehicle. Therefore, even in a downpour of rain or in heavy fog, diffusive reflection of the light in the vertical direction, which would be caused by raindrops or fine particles of water vapor, can be restricted, whereby better forward visibility as compared with conventional light projectors can be ensured.

Figure 7A:
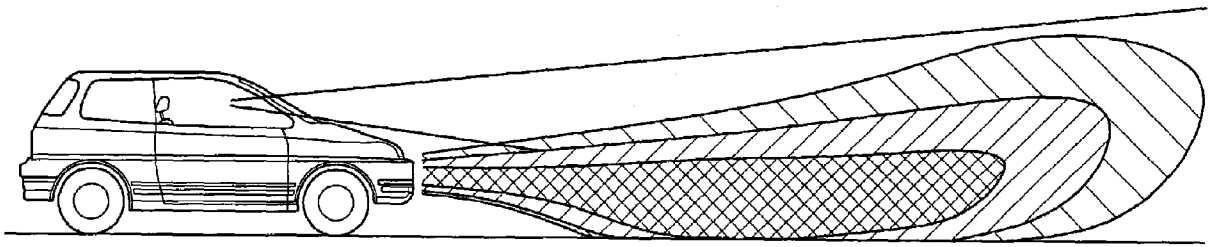
FIG. 7A is a schematic diagram showing distribution of light irradiated from a headlight resulting when a light projector according to the present invention is lit in heavy fog or in a downpour of rain.
Figure 7B:
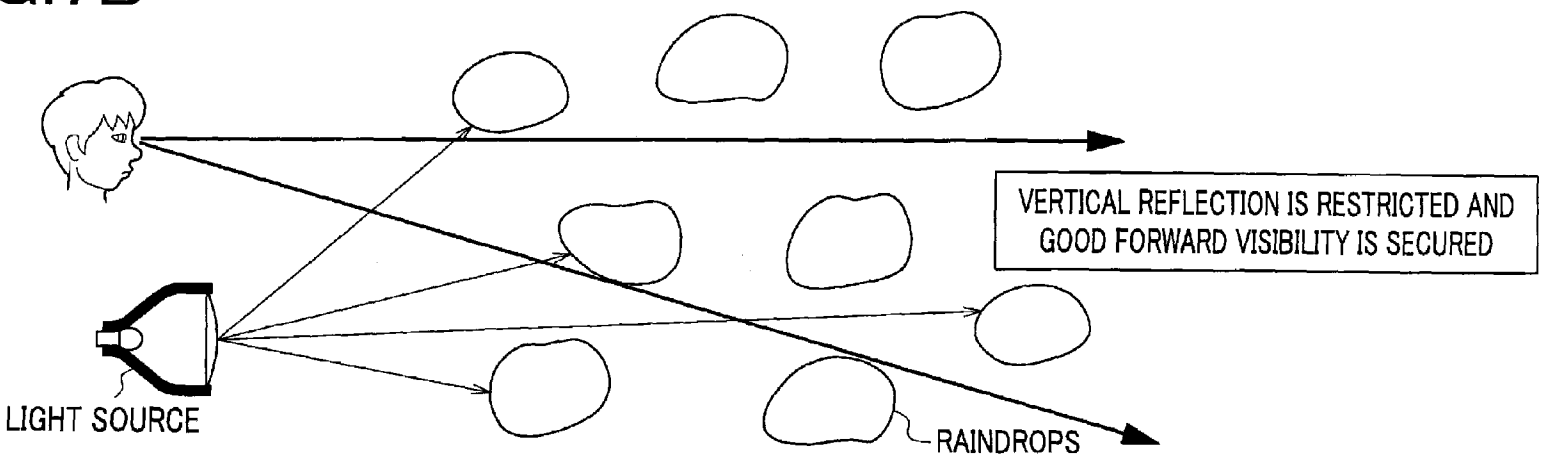
FIG. 7B is a schematic diagram showing diffusion of light which takes place as a result of reflection of light beams irradiated from a light projector according to the present invention on the surfaces of raindrops.

Advantageous effects of the light projector according to the present invention are schematically illustrated in FIG. 7A. FIG. 7A is a schematic diagram showing distribution of light irradiated from a headlight as results when the light projector according to the present invention is lit up in heavy fog or in a downpour of rain. Vertical polarized light irradiated from the headlight of the present invention is far less likely to diffusively reflect in a vertical direction in comparison with conventional headlights that irradiate unpolarized light even if either light strikes on raindrops or fine particles of water vapor alike. Accordingly, a light wall, so called, does not emerge in front of the vehicle, and thus the driver can be securely provided with good forward visibility. FIG. 7B is a schematic diagram showing diffusion of light which takes place on the surfaces of raindrops as a result of reflection of the light beams irradiated from the light projector according to the present invention. Irradiation of vertical polarized light as in the present invention reduces the likelihood of vertically diffusing reflection that could take place on the surfaces of raindrops, allowing the driver to secure adequate forward visibility without obstruction of the light wall.

Moreover, when the vehicle is operated at nighttime in a rainy day, light from other vehicles reflecting off a water layer that exists on the road comes within sight of the driver, and dazzlingly glares from the surface of the road, offering extreme difficulty to the driver who operates the vehicle. However, if the light projector according to the present invention comes into wide use among a great number of vehicles, then the other vehicles also contribute restricted reflection of irradiated light on the surface of the road, so that the drivers can operate the vehicle more comfortably.

Furthermore, the light projector according to the present invention uses the ½ wavelength retardation plate 6 to change the s-polarized light, which has been produced by splitting up unpolarized light utilizing the polarized light beam splitter 3, into the second vertical polarized light, and thus light irradiated from the light source 1 can be utilized efficiently.

Figure 8:
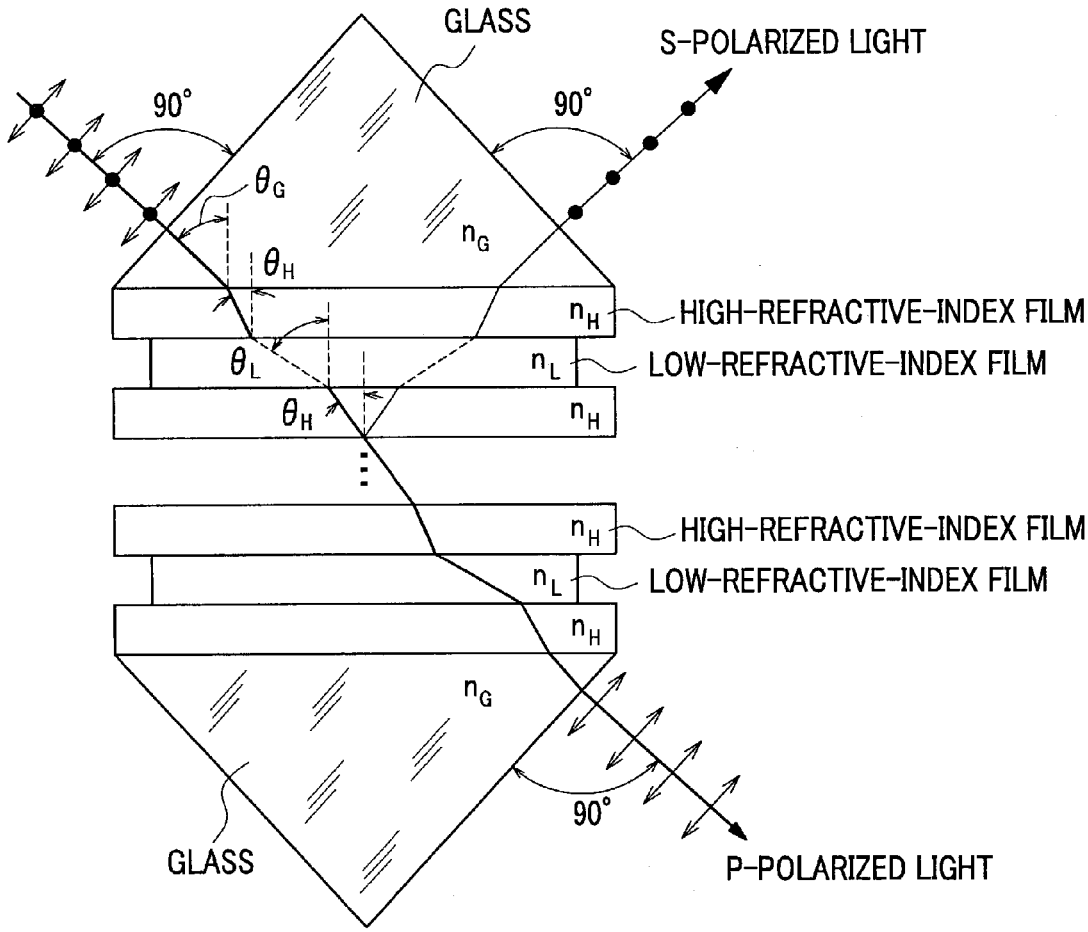
FIG. 8 is a schematic diagram of a polarized light beam splitter.

The polarized light beam splitter 3 as used herein may be implemented by alternately laminating low-refractive-index films and high-refractive-index films between opposite surfaces of a pair of glass prisms, as shown in FIG. 8. The polarized light beam splitter 3 makes good use of a phenomenon in which incident light striking on a medium at a polarizing angle (Brewster's angle) makes the reflectance of p-polarized light zero and allows only s-polarized light to reflect. In the polarized light beam splitter 3, the reflectance and thickness of each film are appropriately designed so that the incident light strikes on the surface of the multilayered films at the polarizing angle. The use of the beam splitter 3 having the above structure makes it possible to split up the incident light to obtain p-polarized light and s-polarized light separately.

In order to split the light into s-polarized light and p-polarized light to be irradiated at right angles with each other, the equation (1) is to be satisfied:

$$n_G=2n_H^2n_L^2/(n_L^2+n_H^2) \quad (1)$$

where $n_H$ is the index of refraction of high-refractive-index films, $n_L$ is the index of refraction of low-refractive-index films, and $n_G$ is the index of refraction of glass.

For example, when $ZrO_2$ ($n_H$=2.04) and $MgF_2$ ($n_L$=1.385) are used as the high-refractive-index films and the low-refractive-index films, respectively, the glass prism made of glass having the index of refraction ($n_G$) of 1.62 may be used.

Although the multilayered structure of high-refractive-index films and low-refractive-index-films is emphasized and enlarged in FIG. 8, actual thicknesses thereof are much less than illustrated.

Alternatively, a device that utilizes a birefringent material to split a light beam into p-polarized light and s-polarized light may be adopted as the polarized light beam splitter 3. When an unpolarized light beam is let into a birefringent material, the light beam can be split into two components; i.e., a p-polarized light component and an s-polarized light component, different from each other in propagation velocity at which each component is transmitted through a crystal of the material, so that the p-polarized light and the s-polarized light can be obtained separately. Among materials usable as the birefringent material are, for example, Calcite ($CaCO_3$) and the like. That is, the polarized light beam splitter 3 made of calcite crystal can be used to obtain p-polarized light and s-polarized light separately.

The light projector according to the present invention splits light irradiated from a light source into p-polarized light and s-polarized light, changes the s-polarized light into vertical polarized light and irradiates the vertical polarized light forward of the vehicle; thus, there should inevitably arise small losses of the amount of light in each of the steps (of splitting light into s-polarized light and p-polarized light, and changing the s-polarized light into vertical polarized light). However, the light projector according to the present invention holds promise of resulting improvement in forward visibility under unfavorable conditions to such an extent as to more than offset the undesired losses. The light source 1 used herein is not limited to an HID lamp, but a lamp using a filament may be employed as usual.

Further, in the present embodiment, the s-polarized light obtained by splitting unpolarized light using the polarized light beam splitter 3 is changed into second vertical polarized light using the ½ wavelength retardation plate 6, and irradiated forward of the vehicle together with first vertical polarized light, but a light projector in which the ½ wavelength retardation plate 6 is not employed can also be conceived.

Figure 9:
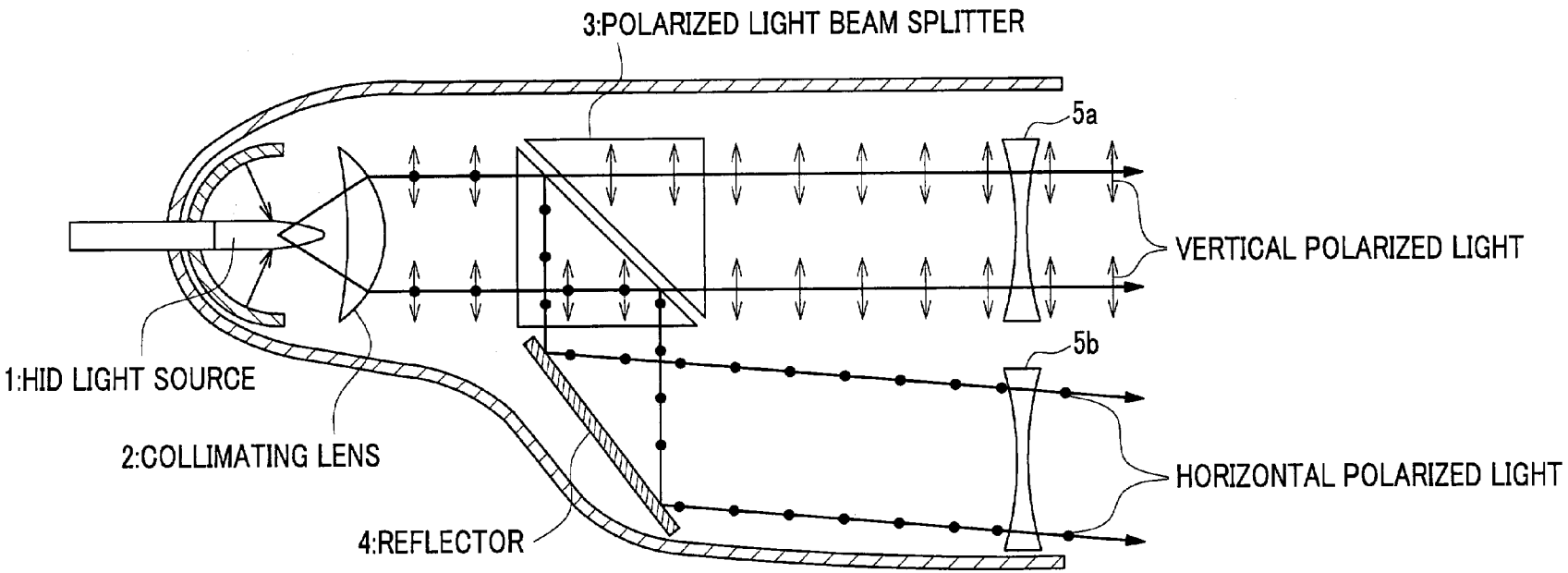
FIG. 9 is a schematic diagram showing another exemplified embodiment of the light projector according to the present invention.

To be more specific, another exemplified embodiment of the light projector according to the present invention as shown in FIG. 9 has the same construction as the light projector as shown in FIG. 6, except that no ½ wavelength retardation plate 6 is provided. In this light projector, the s-polarized light obtained by splitting unpolarized light using the polarized light beam splitter 3 is not changed into vertical polarized light, but irradiated to an area near the vehicle as horizontal polarized light. As diffuse reflection of light irradiated to the area near the vehicle poses no serious problem, such irradiation of horizontal polarized light to the area near the vehicle serves to have a sufficient amount of light secured in the area near the vehicle. On the other hand, the vertical horizontal light based upon the p-polarized light is irradiated to an area farther from the vehicle, and thus improved visibility in a far area can be ensured even under unfavorable conditions.

Furthermore, although the light projector according to the present invention is exemplarily applied to a headlight such as a fog lamp in the above embodiments, the embodiments of the present invention are not limited thereto; i.e., any other light projectors such as a rear fog lamp, a tail lamp, a stop lamp, a back lamp, etc. can be implemented according to the present invention. The use of the light projector according to the present invention for the lamps as recited above in a vehicle enables a driver of another vehicle that follows to easily recognize the presence of the vehicle ahead of his/her own vehicle, even under tough conditions that would restrict forward visibility to an inadequate level (e.g., in a downpour of rain, in heavy fog, etc.), because light irradiated from the lamps is restricted from reflecting off raindrops or fine particles of water vapor.

The light projector according to the present invention can be applied to a searchlight, a flashlight, an illuminating device in a lighthouse, or the like, as well. The light projector according to the present invention applied to various light projectors for use in consumer goods, military installations, for recreational use, for security purposes, or the like can also provide improved forward visibility as compared with conventional light projectors, in heavy fog, in rain, or in adverse conditions of various kinds, in a variety of situations.

Although the preferred embodiments of the present invention have been described above, the present invention is not limited to the explicitly described embodiments; namely, various modifications and changes may be made in the present invention without departing from the spirit and scope thereof.

The present invention constructed as described above produces distinctive advantageous effects as follows.

The light projector as one aspect of the present invention is designed to split light irradiated from a light source into p-polarized light and s-polarized light using a polarized light splitter, and to irradiate the p-polarized light and the s-polarized light as vertical polarized light having electric field plane of vibration substantially vertical to the ground, and/or as horizontal polarized light having electric field plane of vibration substantially parallel to the ground. This arrangement has high efficiency in utilization of light, and high heat resistance, and can provide considerably increased forward visibility under conditions which would restrict the visibility.

The light projector as another aspect of the present invention is designed to irradiate vertical polarized light, which is low in reflectance of light in a direction vertical to the ground, to an area farther from the light source. This arrangement can contribute to reduced reflection of vertically diffusing light that would take place on surfaces of raindrops or fine particles of water vapor in a downpour of rain or in heavy fog. For example, a headlight for a vehicle to which the present invention is applied can provide a driver with sufficient forward visibility even under such adverse conditions. Moreover, the light projector is also designed to irradiate horizontal polarized light to an area nearer to the light source, and thus can utilize light irradiated from the light source efficiently, while ensuring the driver's view near the vehicle.

The light projector as yet another aspect of the present invention is designed to split light irradiated from a light source into p-polarized light and s-polarized light, to irradiate one of the p-polarized light and the s-polarized light as first vertical polarized light, and to change the other of the p-polarized light and the s-polarized light into second vertical polarized light utilizing a phase changer such as a ½ wavelength retardation plate and irradiate the second vertical polarized light. This arrangement can increase the amount of light of the vertical polarized light, which is low in reflectance of light in a direction vertical to the ground, allowing a driver to be more reliably provided with forward visibility, in a case where this aspect of the present invention is applied to a headlight of a vehicle, for example.

A birefringent material may be used for the above polarized light splitter, and if so, unpolarized light generated from the light source can efficiently be split up into s-polarized light and p-polarized light.

The light projector according to the present invention may be used for a headlight of a vehicle, which serves to achieve considerably increased forward visibility of a driver in heavy fog or in a downpour of rain in comparison with a conventional headlight.

What is claimed is:

1. A light projector for polarizing light relative to the ground for increasing visibility from a vehicle through rain, fog, film of water on the ground, comprising:

a light source being supported relative to the ground;

a polarized light splitter that splits a beam of unpolarized light emitted from the light source into p-polarized light and s-polarized light; and means for emitting from the vehicle a vertical polarized light, wherein the vertical polarized light comprises one of:

the p-polarized light provided without reflecting in the polarized light splitter and without changing an incident direction of vibration of electric field, wherein the direction of vibration of electric field of the p-polarized light is parallel to a plane of incidence of the polarized light splitter, and the s-polarized light reflecting in the polarized light splitter with an incident direction of vibration of electric field perpendicular to the p-polarized light, wherein the direction of vibration of electric field of the s-polarized light is perpendicular to the plane of incidence of the polarized light splitter, providing a direction of vibration of electric field of the vertical polarized light that is substantially vertical to the ground, wherein if the plane of incidence of the polarized light splitter is perpendicular to the ground, then the p-polarized light comprises the vertical polarized light, and if the plane of incidence of the polarized light splitter is parallel to the ground, then the s-polarized light comprises the vertical polarized light, wherein the vertical polarized light is emitted to an area farther from the light source than a horizontal polarized light, and the horizontal polarized light is one of the p-polarized light and the s-polarized light not comprising the vertical polarized light.

2. A light projector for polarizing light relative to the ground for increasing visibility from a vehicle through rain, fog, film of water on the ground, according to claim 1, wherein the polarized light splitter is made of material which is birefringent.

3. A light projector according to claim 1, which is used for a headlight for a vehicle.

4. A light projector for polarizing light relative to the ground for increasing visibility from a vehicle through rain, fog, film of water on the ground, comprising:

a light source being supported relative to the ground;

a polarized light splitter that splits a beam of unpolarized light emitted from the light source into p-polarized light and s-polarized light, wherein a direction of vibration of electric field of the p-polarized light is parallel to a plane of incidence of the polarized light splitter, and the direction of vibration of electric field of the s-polarized light is perpendicular to the plane of incidence of the polarized light splitter; and means for emitting from the vehicle a first vertical polarized light, wherein the first vertical polarized light comprises one of:

the p-polarized light provided without reflecting in the polarized light splitter and without changing an incident direction of vibration of electric field, and the s-polarized light reflecting in the polarized light splitter with an incident direction of vibration of electric field perpendicular to the p-polarized light, wherein if the plane of incidence of the polarized light splitter is perpendicular to the ground, then the p-polarized light comprises the first vertical polarized light, and if the plane of incidence of the polarized light splitter is parallel to the ground, then the s-polarized light comprises the first vertical polarized light; and a phase changer, wherein one of the p-polarized light and the s-polarized light not comprising the first vertical polarized light is changed into a second vertical polarized light utilizing the phase changer and is emitted, and the first and second vertical polarized lights are lights having a direction of vibration of electric field substantially vertical to the ground.

5. A light projector according to claim 4, wherein the phase changer is a ½ wavelength retardation plate.

6. A light projector for polarizing light relative to the ground for increasing visibility from a vehicle through rain, fog, film of water on the ground, according to claim 4, wherein the polarized light splitter is made of material which is birefringent.

7. A light projector according to claim 4, which is used for a headlight for a vehicle.

* * * * *